United States Patent [19]

Walkhoff

[11] Patent Number: 4,644,671

[45] **Date of Patent: * Feb. 24, 1987**

[54] ATHLETIC FOOTWEAR, ESPECIALLY A SKI BOOT

[75] Inventor: Klaus Walkhoff, Kreuzlingen, Switzerland

[73] Assignee: Raichle Sportschuh AG, Kreuzlingen, Switzerland

[ * ] Notice: The portion of the term of this patent subsequent to Sep. 10, 2002 has been disclaimed.

[21] Appl. No.: 715,684

[22] Filed: Mar. 25, 1985

[30] Foreign Application Priority Data

Mar. 30, 1984 [CH] Switzerland ..... 1622/84

[51] Int. Cl.[4] ..... A43B 5/04

[52] U.S. Cl. ..... 36/119; 36/120

[58] Field of Search ..... 36/117–121, 36/105, 93, 50

[56] References Cited

U.S. PATENT DOCUMENTS

| | | | |
|---|---|---|---|
| 4,160,332 | 7/1979 | Salomon | 36/119 |
| 4,222,184 | 9/1980 | Kastinger | 36/121 |
| 4,265,034 | 5/1981 | Salomon | 36/121 |
| 4,382,342 | 5/1983 | Spademan | 36/119 |
| 4,539,763 | 9/1985 | Walkhoff | 36/120 |

FOREIGN PATENT DOCUMENTS

| | | | |
|---|---|---|---|
| 0053340 | 6/1982 | European Pat. Off. | 36/120 |
| 0114209 | 8/1984 | European Pat. Off. | 36/119 |
| 0120268 | 10/1984 | European Pat. Off. . | |
| 2907163 | 8/1980 | Fed. Rep. of Germany | 36/120 |
| 3201702 | 9/1982 | Fed. Rep. of Germany . | |
| 2514621 | 4/1983 | France . | |
| 50-97640 | 8/1975 | Japan . | |

*Primary Examiner*—James Kee Chi

*Attorney, Agent, or Firm*—Werner W. Kleeman

[57] ABSTRACT

A saddle-shaped retention member is arranged within a ski boot and can be brought into contact with the middle region of the foot or with a portion of a padded inner shoe covering this middle foot region. Two cable strands engage this retention member, each of which extends on one side of a shell member of the ski boot. Each of these cable strands extends through a bore penetrating a pivot pin. A rear upper portion of the ski boot is pivotably fastened to the shell member by this pivot pin. These penetrating bores are arranged above the pivot axis of the rear upper portion in spaced relationship thereto. The cable strands are fastened to a tensioning lever which is pivotably mounted on the rear upper portion. Since the cable strands extend above the pivot axis of the rear upper portion, the retention member can move forwardly away from the heel region of the ski boot when the upper portion of the ski boot moves forward and entrains the rear upper portion with it toward the toe of the ski boot. This forward motion of the retention member creates space for the middle foot region, which lifts during such a forward motion.

24 Claims, 3 Drawing Figures

ATHLETIC FOOTWEAR, ESPECIALLY A SKI BOOT

CROSS-REFERENCE TO RELATED APPLICATION

This application is related to my commonly assigned, copending U.S. patent application Ser. No. 06/563,042, filed Dec. 19, 1983, and entitled "ATHLETIC FOOTWEAR, IN PARTICULAR A SKI BOOT" now U.S. Pat. No. 4,539,763, granted Sept. 10, 1985.

BACKGROUND OF THE INVENTION

The present invention broadly relates to an article of athletic footwear and, more specifically, pertains to a new and improved construction of a ski boot.

Generally speaking, the article of athletic footwear of the present invention comprises a ski boot having a heel region, a toe region and a longitudinal axis. The ski boot comprises a shell member provided with a sole and with pivot means defining a pivot axis extending transverse to the longitudinal axis of the ski boot. The ski boot also comprises a rear upper portion having an outer side and engaging the pivot means for performing a forward pivoting motion about the pivot axis toward the toe region of the ski boot. The ski boot also comprises a pressure pad arranged within the shell member and intended to act upon the upper side of the foot of a wearer. The ski boot also comprises tensioning means arranged on the outer side of the rear upper portion for moving the pressure pad rearwardly toward the heel region of the ski boot. The ski boot also comprises connecting means for connecting the pressure pad with the tensioning means.

A ski boot of this type is known from the German Patent Publication No. 2,712,001 corresponding to the U.S. Pat. No. 4,160,332, granted July 10, 1979, in which the coupling between a retention member and a rear upper portion (spoiler) is constructed such that when the rear upper portion is pivoted forward toward the toe of the ski boot, the retention member is moved rearward in a direction toward the heel region of the ski boot. This has the result that during a forward lean or biasing motion in active skiing, i.e. when bending the lower leg forward, which causes a forward pivoting of the upper portion of the ski boot and therefore also of the rear upper portion, the force exerted by the retention member upon the foot is increased. This can, during extreme forward motions, lead to such a great pressure upon the foot that the wearer of the ski boot experiences pain.

A further ski boot is known in which a cable or cables connecting a retention member with a tensioning device is guided through pivot pins pivotably connecting a rear upper portion with a shell member such that the cables cross a pivot axis of the rear upper portion (cf. Raichle Sportschuh AG Brochure "Winter 83/84", European Patent Publication No. 0,114,209 and the initially mentioned cognate U.S. patent application Ser. No. 06/563,042, filed Dec. 19, 1983). This guidance of the cables ensures that the force exerted by the retention member upon the foot changes not at all or at most very little during a pivoting motion of the upper portion of the ski boot and therefore also of the rear upper portion. However, experience has shown that during an extreme forward motion a pressure effect upon the foot can nevertheless arise which is unpleasant or even painful to the wearer.

SUMMARY OF THE INVENTION

Therefore, with the foregoing in mind, it is a primary object of the present invention to provide a new and improved construction of an article of athletic footwear which does not exhibit the aforementioned drawbacks and shortcomings of the prior art constructions.

Another and more specific object of the present invention aims at providing a new and improved construction of an article of athletic footwear of the previously mentioned type in which comfort to the wearer is maintained even when the lower leg is bent forward, while the foot of the wearer is well-seated in the ski boot.

Yet a further significant object of the present invention aims at providing a new and improved construction of an article of athletic footwear of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the article of athletic footwear of the present invention is manifested by the features that a retention member or pressure pad is capable of performing a forward motion away from the heel region of the ski boot when the rear upper portion performs a forward pivoting motion.

Since the retention member or pressure pad moves in a direction away from the heel region of the ski boot during a forward lean or biasing motion in which also the rear upper portion is pivoted forward, space is available for the middle or instep region of the foot of the boot wearer, which lifts during forward bending of the lower leg. The retention member or pressure pad can therefore follow the lifing middle foot or instep and presents no resistance to such a lifting motion. The foot is still pulled to the rear with a sufficiently great force, yet without exerting a pressure upon the foot great enough to cause pain.

The connecting means between the retention member or pressure pad and the tensioning means preferably comprises at least one longitudinal connecting element, which may for instance be a cable, which extends above the pivot axis of the rear upper portion and transverse to this pivot axis in the region of the connection location between the shell member and the rear upper portion at least with its longitudinal central axis.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
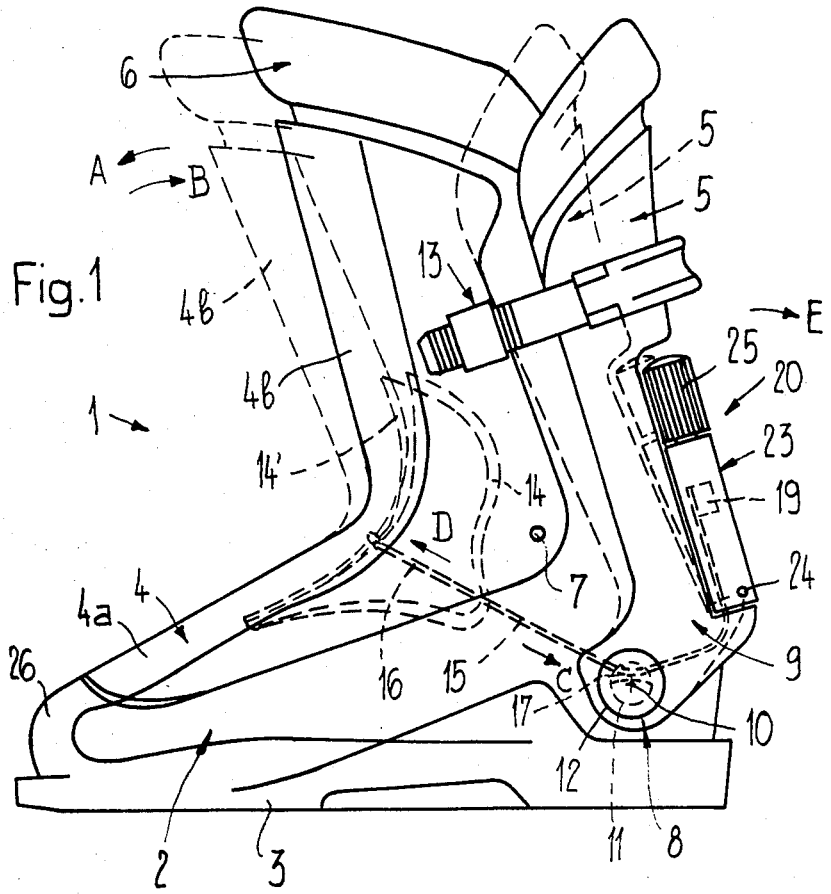
FIG. 1 schematically illustrates a ski boot according to the invention in side view.

Describing now the drawings, it is to be understood that to simplify the showing thereof only enough of the structure of the article of athletic footwear has been illustrated therein as is needed to enable one skilled in the art to readily understand the underlying principles and concepts of this invention. Turning now specifically to FIG. 1 of the drawings, the ski boot 1 illustrated therein by way of example and not limitation will be seen to comprise a relatively rigid shell member 2 surrounding the foot of the wearer and having a sole 3, a tongue portion 4 covering the instep and shin region as well as a rear upper portion 5 (spoiler) supporting the heel and calf region. A soft, padded, inner shoe 6 is arranged in known manner in the interior of the outer shell formed by the previously mentioned components. The tongue portion 4 comprises a lower tongue region 4*a* covering the instep region and an upper tongue region 4*b* covering the lower shin region of the wearer. This tongue portion 4 engages over the shell member 2 in saddle fashion and is connected to this shell member 2 at connection locations 7. The upper tongue region 4*b* of the tongue portion 4 can be pivoted about the pivot axis defined by the two pivot locations 7, which permits this upper tongue region 4*b* to follow the motions of the lower leg of the wearer.

The rear upper portion 5 is pivotably connected to the shell member 2 on both sides of the shell member 2 at pivot locations 8, only one of which is visible in the drawings. The pivot locations 8 are arranged on opposite sides of the longitudinal direction or axis of the ski boot and in the heel region 9 thereof. These pivot locations 8 define the pivot axis 10 of the rear upper portion 5 which extends transverse and substantially perpendicular to the longitudinal axis of the ski boot 1. The rear upper portion 5 is therefore also able to follow pivoting motions of the lower leg. The connection between the shell member 2 and the rear upper portion 5 is effected by pivot members which each comprise a cylindrical pivot pin 11. These pivot pins 11 comprise a thread at their outer ends, upon which a nut or threaded cap 12 is screwed from the outer side of the ski boot 1. The pivot axis of the rear upper portion 5 coincides with the longitudinal axis of the pivot pins 11.

The rear upper portion 5 can be releasably connected to the tongue portion 4 by a conventional closure device or retaining element 13.

A saddle-shaped retention member or pressure pad 14 which is arranged in the interior of the shell member 2, but on the upper side of the inner shoe 6, can be brought into contact with the foot of a wearer or with the inner shoe 6 for retaining the foot. This retention member or pressure pad 14 is connected with the shell member 2 in not particularly shown conventional manner such that it can move in the longitudinal direction of the ski boot 1 by a certain amount.

Two cable strands 15, only one of which is visible in the drawings, extend on mutually opposite inner sides of the shell member 2. The two cable strands 15 are connected to one another in the region of the retention member or pressure pad 14 by an arcuate connection piece 16 which extends over the retention member or pressure pad 14.

The cable strands 15 protrude from the inner side of the shell member 2 through a bore 17 penetrating an associated pivot pin 16. As can be particularly well seen in FIG. 2, these penetrating bores 17 are arranged above the longitudinal axis of the pivot pins 11, i.e. above the pivot axis 10 of the rear upper portion 5. The longitudinal axis of the bore 17 is designated with the reference character 17*a* in FIG. 2 and is situated above the pivot axis 10 at a distance a. The bores 17 each comprise a conical enlargement 18 at their rear ends (cf. FIG. 2). This arrangement of the bores 17 above the pivot axis 10 ensures that the cable strands 15 are conducted through the pivot pins 11 entirely or at least partially above the pivot axis 10.

The cable strands 15 protruding from the bores 17 are subsequently conducted on the inner side of the rear upper portion 5 to an anchoring element 19 which is constructed as a nut or threaded block and constitutes a component of a tensioning mechanism 20. Both cable strands 15 are connected to one another in the region of this anchoring element 19. The anchoring element 19 upon which the cable strands 15 are fastened sits upon a threaded spindle 21 (cf. FIG. 2) which is arranged in the interior of a tensioning lever 23 and extends in the longitudinal direction thereof. This tensioning lever 23 is pivotably mounted to the rear upper portion 5 about an axis 24 extending substantially perpendicular to the longitudinal direction of the ski boot 1. A knurled head 25, by means of which the threaded spindle 21 can be rotated, is arranged at the free end of the tensioning lever 23 and is connected with the threaded spindle 21. During rotation of the threaded spindle 21, the nut or threaded block defining the anchoring element 19 translates and effects, through the cable strands 15, an alteration of the position of the retention member or pressure pad 14, as described in more detail in the previously mentioned European Patent Publication No. 0,114,209 and its aforementioned cognate U.S. application.

If the tensioning lever 23 is pivoted rearward away from the rear upper portion 5 in the direction of the arrow E out of its tensioning position illustrated in the drawings, then the cable strands 15 are loosened or relaxed and the retention member or pressure pad 14 is free to move in the direction of the arrow D. When pivoting the tensioning lever 23 back into the tensioned position, the retention member or pressure pad 14 is pulled back in the direction of the arrow C toward the heel region 9 of the ski boot, as also described in the previously mentioned European Patent Publication No. 0,114,209 and its aforementioned cognate United States application.

When the ski boot 1 is closed and the tensioning lever 23 is in the tensioned position, a force acting toward the rear in the direction of the heel region 9 acts upon the foot of the wearer through the retention member or pressure pad 14 and retains the foot. The amount of this force can be adjusted by rotating the threaded spindle 21.

Figure 2:
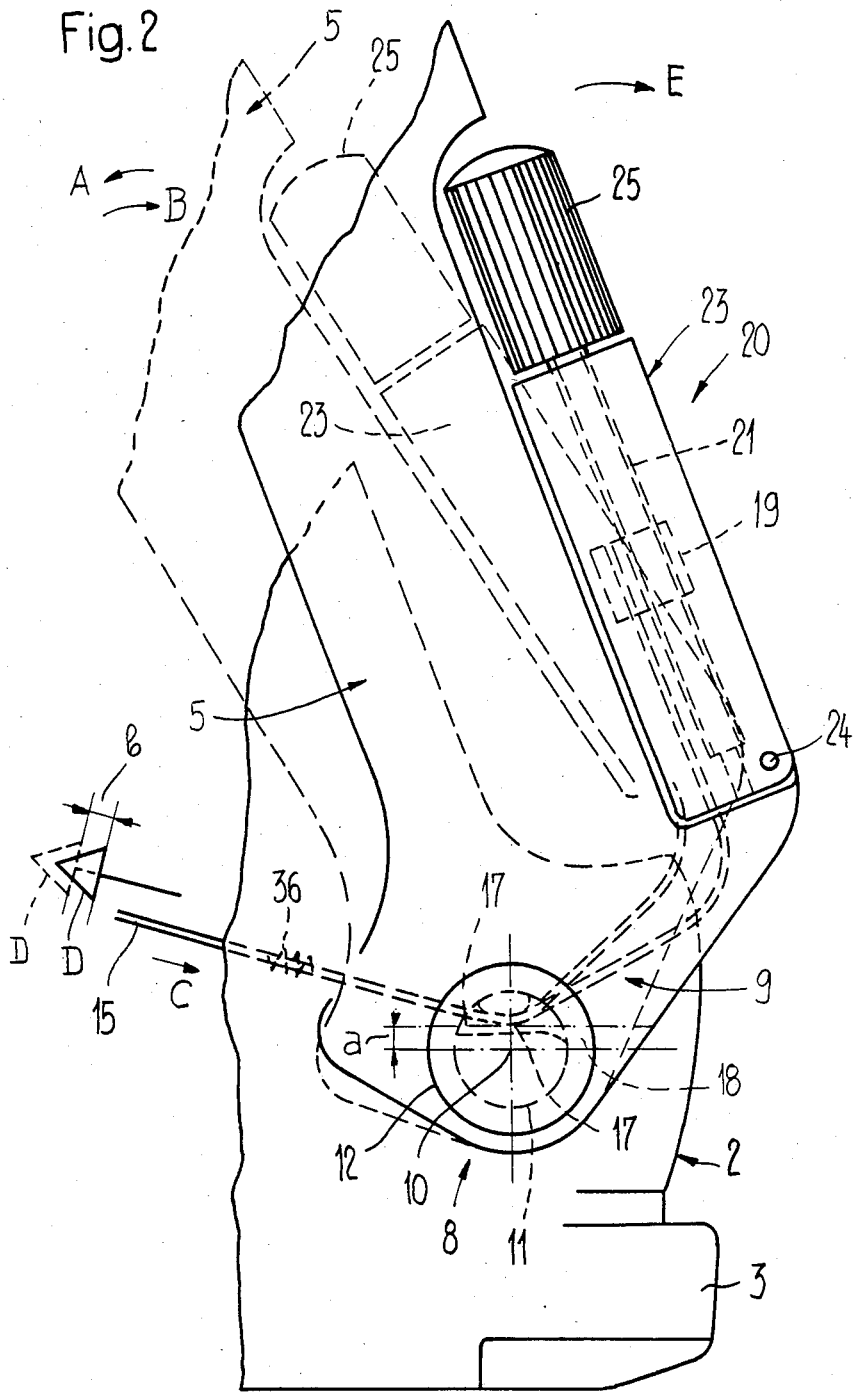
FIG. 2 schematically shows the heel region of the ski boot of FIG. 1 in side view and on an enlarged scale.

If the lower leg is bent forward during skiing, then the upper boot portion, i.e. both the upper tongue region 4*b* and the rear upper portion 5, moves forward in the direction A toward the toe 26 of the ski boot 1 and assumes, for instance, the position shown in dotted line in FIGS. 1 and 2. Since the bores 17, through which the cable strands 15 extend, extend as mentioned above the pivot axis 10 of the rear upper portion 5, the cable strands 15 can move in the direction of the arrow D.

This permits the retention member or pressure pad 14 to also move in the direction D, i.e. forwardly in the direction away from the heel region 9. This path of motion of the retention member or pressure pad 14 is indicated by the reference character b in FIG. 2. This forward motion of the retention member or pressure pad 14 renders space available for the middle region or instep of the foot enclosed in the ski boot 1 as it rises or lifts during a forward biasing motion.

Figure 3:
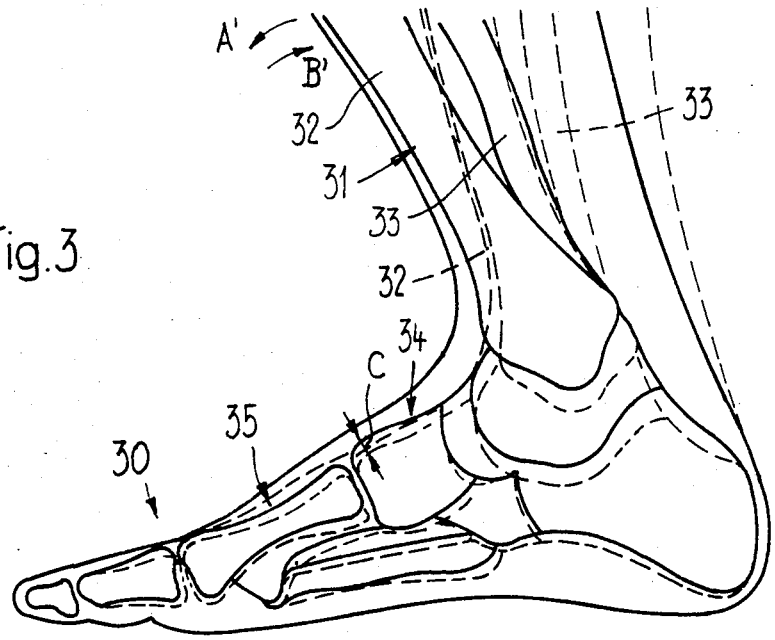
FIG. 3 schematically illustrates a human foot with a portion of the lower leg.

This lifting or rising of the middle foot region or instep will be explained in relation to FIG. 3. A foot 30 and a portion of a lower leg 31 having a tibia or shin bone 32 and fibula or calf bone 33 are schematically illustrated in FIG. 3. The cuneiform bones of the foot are designated by the reference numeral 34 and the metatarsal or longitudinal instep bones are designated with the reference numeral 35. When the lower leg is in an upright position, as indicated in dotted line, the cuneiform bones 34 and the metatarsal bones 35 assume the position also indicated in dotted lines. If the lower leg is now bent forward in the direction of the arrow A' into the position illustrated in full or solid lines, then the cuneiform bones 34 and the metatarsal bones 35 lift or rise and assume the position illustrated in solid lines. The amount of this lifting motion is indicated in FIG. 3 with the reference character c.

Since the retention member or pressure pad 14 is given the already mentioned possibility of moving forward in the direction of the arrow D during a pivoting motion of the rear upper portion 5 of the ski boot 1 in the direction of the arrow A, this retention member or pressure pad 14 can follow the lifting motion of the middle foot or instep region just described. The retention member or pressure pad 14 still does exert a retention force directed rearwardly toward the heel region of the ski boot 1 upon the foot, but nevertheless does not press too strongly against the foot. A strong pressure effect of this type would arise if the retention member or pressure pad 14 had to maintain its position and could not follow the lifting motion of the middle foot or instep.

If the upper boot portion is pivoted back again in the direction of the arrow B into its normal position indicated in solid lines in FIG. 1, then the retention member or pressure pad 14 is moved in the direction of the arrow C from the position designated with the reference character 14' in FIG. 1 back into the normal position designated with the reference numeral 14 again by the cable strands 15. The retention member or pressure pad 14 therefore also follows the motion of the middle foot or instep region during the return motion of the tibia 32 and of the upper boot portion into the normal position.

Providing, as mentioned, conical enlargements 18 on the rear ends of the penetrating bores 17 ensures that the cable strands 15 can move freely in the region of the rear ends of the bores 17 during a forward motion of the rear upper portion 5 and that this motion is not inhibited by the walls of the penetrating bores 17.

It will be understood that the various components of the ski boot described herein can also be constructed differently than described and illustrated. For instance, it is possible to provide only a single cable strand 15 and to fasten the retention member or pressure pad 14 to the side of the shell member 2 lying opposite such a single cable strand 15. It is further conceivable to construct the tensioning mechanism 20 in other suitable manner, for instance in the manner shown in the European Patent Publication No. 0,053,340.

At least one damping member is advantageously arranged in the connection between the retention member or pressure pad 14 and the tensioning lever 23. This damping member is elastically deformed during a forward motion of the retention member or pressure pad 14 in the direction of the arrow D which, as mentioned, arises during a bending of the lower leg 31 forward and the associated lifting of the middle foot region 34, 35, and thus cushions this forward motion. This damping member can, for instance, be a spring incorporated in the cable strands 15, as indicated in dotted lines in FIG. 2 and designated with the reference numeral 36. An intermediate member with the properties of elastic rubber can also be employed in place of such a spring. It is, however, also conceivable to construct the mounting location of the cable strands 15 in the anchoring element 19 such that the desired elastic yielding effect is achieved.

While there are shown and described present preferred embodiments of the invention, it is to be distinctly understood that the invention is not limited thereto, but may be otherwise variously embodied and practiced within the scope of the following claims. Accordingly,

What I claim is:

1. An article of athletic footwear, especially a ski boot, having a heel region, a toe region and a longitudinal axis and comprising:

a shell member;

said shell member being provided with a sole;

said shell member being provided with pivot means defining a pivot axis extending transverse to the longitudinal axis;

a rear upper portion having an outer side and engaging said pivot means for performing a forward pivoting motion about said pivot axis toward the toe region;

a pressure pad arranged within said shell member to act upon an upper side of the foot of a wearer;

tensioning means arranged on said outer side of said rear upper portion for moving said pressure pad rearwardly toward the heel region;

connecting means for connecting said pressure pad with said tensioning means; and said pressure pad being capable of performing a forward motion away from the heel region when said rear upper portion performs said forward pivoting motion.

2. The article of athletic footwear as defined in claim 1, wherein:

said connecting means comprises at least one elongate connecting element having a longitudinal central axis; and said at least one elongate connecting element extending at least with said longitudinal central axis thereof above said pivot axis and transverse to said pivot axis.

3. The article of athletic footwear as defined in claim 2, wherein:

said connecting means comprises a cable.

4. The article of athletic footwear as defined in claim 2, wherein:

said connecting means comprises two elongate connecting elements;

each connecting element of said two elongate connecting elements extending on a respective side of the article of athletic footwear; and each said elongate connecting element extending at least with said longitudinal central axis thereof above said pivot axis.

5. The article of athletic footwear as defined in claim 4, wherein:

said pivot means comprises at least one pivot member connecting said rear upper portion to said shell member; and each said elongate connecting element being guided above said pivot axis by said at least one pivot member.

6. The article of athletic footwear as defined in claim 5, wherein:

said at least one pivot member is provided with a bore;

each said elongate connecting element being guided through said bore;

said bore having a rear end; and said rear end being substantially conically enlarged.

7. The article of athletic footwear as defined in claim 6, wherein:

said at least one pivot member comprises at least one cylindrical pin;

said at least one cylindrical pin having a longitudinal pin axis substantially coincident with said pivot axis; and said bore extending above said longitudinal pin axis in spaced relationship thereto.

8. The article of athletic footwear as defined in claim 4, wherein:

said tensioning means comprises a tensioning lever;

said tensioning lever comprising a mounting location for said two elongate connecting elements; and said tensioning lever being pivotably mounted upon said rear upper portion.

9. The article of athletic footwear as defined in claim 8, wherein:

said rear upper portion defines a tensioning pivot axis; and said tensioning lever being pivotable about said tensioning pivot axis.

10. The article of athletic footwear as defined in claim 8, wherein:

said tensioning lever defines a longitudinal lever direction;

said tensioning means comprises an anchoring element for said two elongate connecting elements; and said anchoring element being adjustable in said longitudinal lever direction.

11. The article of athletic footwear as defined in claim 10, wherein:

said tensioning means comprises a threaded spindle having a head portion; and said anchoring element being adjustable by said threaded spindle.

12. The article of athletic footwear as defined in claim 11, wherein:

said threaded spindle extends within said tensioning lever.

13. The article of athletic footwear as defined in claim 11, wherein:

said threaded spindle has a free end; and said head portion being arranged at said free end.

14. The article of athletic footwear as defined in claim 2, wherein:

said tensioning means comprises a tensioning lever;

said tensioning lever comprising a mounting location for said at least one elongate connecting element; and said tensioning lever being pivotably mounted upon said rear upper portion.

15. The article of athletic footwear as defined in claim 14, wherein:

said rear upper portion defines a tensioning pivot axis; and said tensioning lever being pivotable about said tensioning pivot axis.

16. The article of athletic footwear as defined in claim 14, wherein:

said tensioning lever defines a longitudinal lever direction;

said tensioning means comprises an anchoring element for said at least one elongate connecting element; and said anchoring element being adjustable in said longitudinal lever direction.

17. The article of athletic footwear as defined in claim 16, wherein:

said tensioning means comprises a threaded spindle having a head portion; and said anchoring element being adjustable by said threaded spindle.

18. The article of athletic footwear as defined in claim 17, wherein:

said threaded spindle extends within said tensioning lever.

19. The article of athletic footwear as defined in claim 17, wherein:

said threaded spindle has a free end; and said head portion being arranged at said free end.

20. The article of athletic footwear as defined in claim 1, wherein:

said connecting means is provided with elastic means; and said elastic means being forwardly elastically deformable when said pressure pad performs said forward motion thereof.

21. The article of athletic footwear as defined in claim 1, wherein:

said connecting means comprises at least one elongate connecting element having a longitudinal central axis;

said shell member having a connection location in common with said rear upper portion;

said pivot axis being associated with said rear upper portion; and said at least one elongate connecting element extending at least with said longitudinal central axis thereof above said pivot axis and transverse to said pivot axis in the region of said connection location.

22. An article of athletic footwear, especially a ski boot, having a heel region, a toe region and a longitudinal axis and comprising:

a shell member and a rear upper portion;

said shell member being provided with a sole and pivot means defining a pivot axis extending transverse to the longitudinal axis;

said rear upper portion having an outer side and engaging said pivot means for performing a closure pivoting motion between a rearward open position and a forward closed position and a further forward pivoting motion beyond said forward closed position about said pivot axis toward the toe region;

a pressure pad arranged within said shell member to act upon an upper side of the foot of a wearer;

tensioning means arranged on said outer side of said rear upper portion for moving said pressure pad rearwardly toward the heel region substantially independently of said closure pivoting motion;

connecting means for connecting said pressure pad with said tensioning means; and said pressure pad being capable of performing a slight forward motion away from the heel region when said rear upper portion perform said forward pivoting motion beyond said forward closed position.

23. The article of footwear as defined in claim 22, wherein:

said tensioning means is solely arranged on said outer side of said rear upper portion.

24. The article of footwear as defined in claim 22, wherein:

said connecting means is arranged above and to pass in close proximity to said pivot axis defined by said pivot means.

* * * * *